US007484335B1

(12) United States Patent
Dunlap

(10) Patent No.: US 7,484,335 B1
(45) Date of Patent: Feb. 3, 2009

(54) SOFFIT VENT ASSEMBLY AND METHOD

(76) Inventor: Stephen Dunlap, 12118 Holderrieth Rd., Tomball, TX (US) 77375

( * ) Notice: Subject to any disclaimer, the term of this patent is extended or adjusted under 35 U.S.C. 154(b) by 516 days.

(21) Appl. No.: 10/885,548

(22) Filed: Jul. 6, 2004

(51) Int. Cl.
*E04D 13/00* (2006.01)
*E04B 1/70* (2006.01)
*E04B 1/00* (2006.01)

(52) U.S. Cl. ..... 52/95; 52/742.12; 52/302.3

(58) Field of Classification Search ..... 52/742.12, 52/94, 95, 96, 302.1, 302.3, 302.4; 454/260
See application file for complete search history.

(56) References Cited

U.S. PATENT DOCUMENTS 3,174,421 A * 3/1965 Gray ..... 52/95
4,195,455 A * 4/1980 Chalmers et al. ..... 52/94
5,718,086 A * 2/1998 Dunn ..... 52/95
5,799,446 A 9/1998 Tamlyn
5,916,095 A 6/1999 Tamlyn
5,937,592 A 8/1999 Tamlyn
5,960,598 A 10/1999 Tamlyn
6,018,924 A 2/2000 Tamlyn
6,705,052 B1 * 3/2004 Larson ..... 52/95
6,718,699 B1 * 4/2004 Larson ..... 52/95
2002/0124484 A1 * 9/2002 Martin ..... 52/94

FOREIGN PATENT DOCUMENTS

JP 06010468 A * 1/1994

OTHER PUBLICATIONS

New Products, Vinyl Corp from Internet Archive, Aug. 23, 2001, p. 2.*

* cited by examiner

*Primary Examiner*—Richard E Chilcot, Jr.
*Assistant Examiner*—Elizabeth A Plummer
(74) *Attorney, Agent, or Firm*—Kenneth L Nash

(57) ABSTRACT

The present invention provides a soffit assembly and method which comprises a soffit vent that can be mounted therein regardless of the lookouts to which the soffit boards are typically nailed. In one preferred embodiment, legs extend into a soffit opening. The soffit legs preferably comprise retainers mounted thereon that grasp an inside surface of the soffit boards once inserted fully therein. The base vent portion preferably comprises finish edges that produce a biasing force which is applied against a lower surface of the soffit boards to thereby hold the soffit vent in tension to quickly and easily provide a finished look.

15 Claims, 3 Drawing Sheets

SOFFIT VENT ASSEMBLY AND METHOD

BACKGROUND OF THE INVENTION

1. Field of the Invention

The present invention relates generally to soffit assemblies and, in a presently preferred embodiment, provides an easily mounted soffit vent assembly to reliably provide an aesthetically pleasing finish.

2. Description of the Prior Art

The underside of a structural component, such as a beam, arch, staircase, or cornice is often referred to as a soffit. In building construction, the underside of a roof eave is referred to as the soffit.

In the construction of buildings such as houses, residences, apartment buildings, and various other types of buildings, the soffit of the roof eave may preferably be vented. One advantage of venting the soffit is that of improving circulation in the attic or other spaces under the roof to thereby significantly reduce cooling costs.

Prior art attempts to provide an easily mounted soffit have been problematic. The following patents and documents show prior art attempts to reduce the time and cost of installing soffit vents:

U.S. Pat. No. 5,799,446, issued Sep. 1, 1998, to J. T. Tamlyn, purports to disclose the following: a soffit assembly made of inside and outside soffit boards, each comprising two or more serially arranged boards. When assembled, the inside and outside soffit boards define a central gap closed by a vent strip having perforations there along to enable breathing through said vent strip. The vent strip also includes left and right U-shaped receptacles to enable the vent strip to snap to the adjacent soffit boards. A cross strip is also set forth which has an H-shape in profile to enable the adjacent boards to be abutted against each other and thereby joined with said cross strip at the joint between the boards.

U.S. Pat. No. 6,018,924, issued Feb. 1, 2000, to J. T. Tamlyn, purports to disclose the following: an adjustable reveal for use in wall construction. In a framed wall, a first and second panel are positioned on the wall to define parallel edges. The spacing between the edges is adjusted so that a sight area is seen between them. A back panel parallel to the two edges is positioned adjacent to the frame and supports an integrally-made extending J-shaped slot which is adapted to clasp around and along the edge on one of said panels. A movable J-shaped slot encloses the other edge, thereby defining the visible site area between the two edges. The back panel is integral with one of the J-shaped slots, and the other is preferably positioned in front of the back panel.

U.S. Pat. No. 5,916,095, issued Jun. 29, 1999, to J. T. Tamlyn, purports to disclose the following: a strip for protecting the lower edge of framing of a structure above foundation. It attaches at the outer face of the foundation and framing to protect the interface. Moreover, it extends outwardly. In one embodiment, a normal shoulder or face abuts the marginal edge of sheet panel material. In another embodiment, an angle face is located so that the strip can be positioned under a first plank to define a sloping angle so that overlapped planks can be built on the exterior to shed rain.

U.S. Pat. No. 5,937,592, issued Aug. 17, 1999, to J. T. Tamlyn, purports to disclose the following: a soffit construction is set forth for use under the eave of a roof overhang on a building. A lengthwise soffit board (one or more serially arranged) is placed parallel to and at the top end of the outside wall under the cove. There is a first outside soffit board which is parallel to an inside soffit board. The two boards in series are arranged to define a gap. The two soffit boards define parallel edges to enable a vent strip to be snapped between the two edges. The vent strip engages the board's edges to position a covering in the gap with a set of perforations there to enable air flow up into the roof for ventilation purposes.

U.S. Pat. No. 5,960,598, issued Oct. 5, 1999, to J. T. Tamlyn, purports to disclose the following: an inside strip which is installed at the inside corner of a typical frame construction building having an external veneer. The framing defines a corner post with framing extending behind two walls at right angles. The two walls are covered with an external veneer such as a sheet layer or horizontal or vertical planking. At the inside corner to exclude the intrusion of water which might otherwise cause rotting, an inside strip is installed. It has the shape of a W-fold defining a center edge which is located at a position typically exposed along the inside corner. The elongate strip of W-fold construction includes outer marginal rectangular faces which are caught behind the wall during construction so that the strip is held in position to protect against the entry of water and inclement weather at the inside corner.

Instructions for Installing Tamlyn Brand SNAPVENT® soffit vent based on the U.S. Pat. Nos. 5,799,446 and 5,937,592, discloses the following steps for installation:

1. Allow for 2" channel width of Snapvent (2¾" channel width if using wide Snapvent) in your overall soffit material width calculation (Snapvent legs are installer-friendly in covering ½" past the channel cut on each side).

2. Working inside out, install inner soffit board, nail to lookouts. Don't nail within 2" of desired vent location to avoid soffit material being overly tight against lookouts.

3. Install Snapvent on inner soffit board (Snapvent will hang loosely on other side). Installed Snapvent should have a smooth flat finish—not recessed.

4. Slide other Snapvent side into outer soffit board, nail to lookouts.

5. At natural seam of end of 8' Snapvent and soffit install Tamlyn vinyl H Mold across to cover both seams. (The smaller leg of the H Mold should face down.) Terminate vent approximately one (1) foot from corners.

6. To finish, nail through soffit into lookouts approximately 2" from the vent on either side. This will securely hold Snapvent in place.

The above cited prior art results in numerous installation problems and inefficiencies. As per the above assembly instructions, which describe the soffit vent shown in several of the above patents, the inner soffit board is first installed, then the soffit vent is installed, and then the outer soffit board is installed. Due to the difficult mounting procedure, this assembly process normally requires two construction workers. This prior art soffit vent is also difficult or impossible to remove, as may sometimes be desired, without removing a soffit board.

Other prior art problems include the need to spackle or paint over nails utilized to secure the soffit boards in position to thereby cover their presence, a time-consuming job. In the prior art, close soffit assembly tolerances are required to install the soffit vent thereby increasing construction time. If the soffit board thickness is not very close in tolerance to the requirements of the prior art soffit assembly requirements, problems in appearance may result. For instance, if the soffit board is too thick by even a small tolerance, perhaps by one-thirty-seconds of an inch, a particular size soffit vent may not fit correctly. For instance, if it is too thin, it will produce a shadow. The close tolerance requires manufacture of a large number of different size vents thereby manufacturing costs. If the soffit board is too thin, a shadow may be produced as the soffit vent hangs down which may then require spackling and/or paint to cover.

Consequently, there remains a need to provide an improved soffit vent assembly system and method. Those of skill in the art will appreciate the present invention, which addresses the above problems and other significant problems uncovered by the inventor that are discussed hereinafter.

SUMMARY OF THE INVENTION

Accordingly, it is an objective of the present invention to provide an improved soffit assembly and method.

Another objective is provide a quickly installed or removed soffit vent.

Another objective is to provide a soffit vent that can be installed with loose soffit assembly tolerances and still achieve an improved finished look.

Yet another objective is to provide a soffit vent assembly and method that avoids the need to spackle nails after assembly to cover their presence.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages. Moreover, the scope of this patent is not limited to its literal terms but instead embraces all equivalents to the claims described.

The present invention comprises a soffit vent for use in a soffit assembly. In one preferred embodiment, the soffit assembly may comprise an inside soffit board portion and an outside soffit board portion that define a soffit opening. Typically, a plurality of lookouts span the soffit opening. The soffit vent may comprise one or more elements such as, for instance, an elongate base portion defining one or more vent holes therein. Additional elements may comprise at least two finish edges extending outwardly from the from opposite sides of the elongate base portion. The finish edges may be biased to resiliently engage lower surfaces of the inside soffit board portion and outside soffit board portion after the elongate base portion is inserted into the soffit vent opening. The finish edges may be flexible or rigid and/or may be resiliently mounted to a flexible lower vent portion. In this manner, the resilient finish edges produce a biasing force against the lower surfaces of the inside soffit board portion and the outside soffit board portion to bias or push the elongate base away from the inside soffit board portion and the outside soffit board portion. The resulting position of the soffit vent is uniform and precise. It gives a predictable polished appearance.

The base portion may preferably have an elongate width approximately equal to an elongate width of the soffit opening. The outermost edges or span of the finish edges is greater than the elongate width of the soffit opening. In one preferred embodiment, the soffit vent may be extruded or molded in one piece whereby the elongate base portion and the at least two edges are formed as a single monolithic piece during manufacture thereof.

In one preferred embodiment, retainers may be mounted to the elongate base portion to engage the inside soffit board portion and the outside soffit board portion after insertion of the soffit vent into the soffit opening thereby effectively locking the soffit vent in position. However, if desired, the soffit vent may be designed such that with sufficient removal force acting to pull the soffit vent strip out of the soffit opening, the retainers and/or elongate base portion flexes to permit removal of the soffit vent strip without the need to remove the soffit boards.

The soffit vent may further comprise one or more legs mounted to the elongate base portion and extending away from the base portion such that the one or more legs are preferably adapted for insertion into the soffit opening. Preferably, the one or more legs define a plurality of leg gaps spaced in coordination with the plurality of lookouts to thereby permit insertion of the one or more legs on the elongate base portion into the soffit opening without being blocked by the lookouts. In a preferred embodiment, the retainers are then position on the legs or comprise a portion of the legs.

The legs may preferably be mounted on opposite sides of the elongate base portion and may preferably be flexibly or resiliently mounted either in that the legs are flexible and/or the elongate base portion is flexible. The retainers may preferably define a profile configured to retain the soffit vent in position after insertion of the base portion into the soffit opening. For instance, in one preferred embodiment, the retainers may comprise a hook shape. Other suitable shapes may also be utilized whereby the retainers effectively affix the vent strip rigidly in position.

In one preferred embodiment, the flexible finish edge extending outwardly from each side of the base portion and form an angle with respect to the base portion.

A method for making a soffit vent in a soffit assembly is also provided comprising one or more steps such as, for instance, providing retainers on the soffit vent that compress inwardly, due to flexibility in the elongate base portion and/or retainers, as the soffit vent is initially inserted into the soffit opening and/or providing that the compressible retainers and/or elongate base portion are resilient to thereby spring outwardly with continued insertion into the soffit opening to thereby lock the soffit vent in position. The method may further comprise providing a finish edge on a base portion of the soffit vent to engage an underside of the inside soffit board portion and the outside soffit board portion. The method may further comprise providing that the finish edge extends outwardly to cover any nails that are adjacent the soffit opening. Another advantage of the present invention is that it gives builders the option to complete the soffit assembly, including painting, and then put in the soffit vent.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

Figure 1:
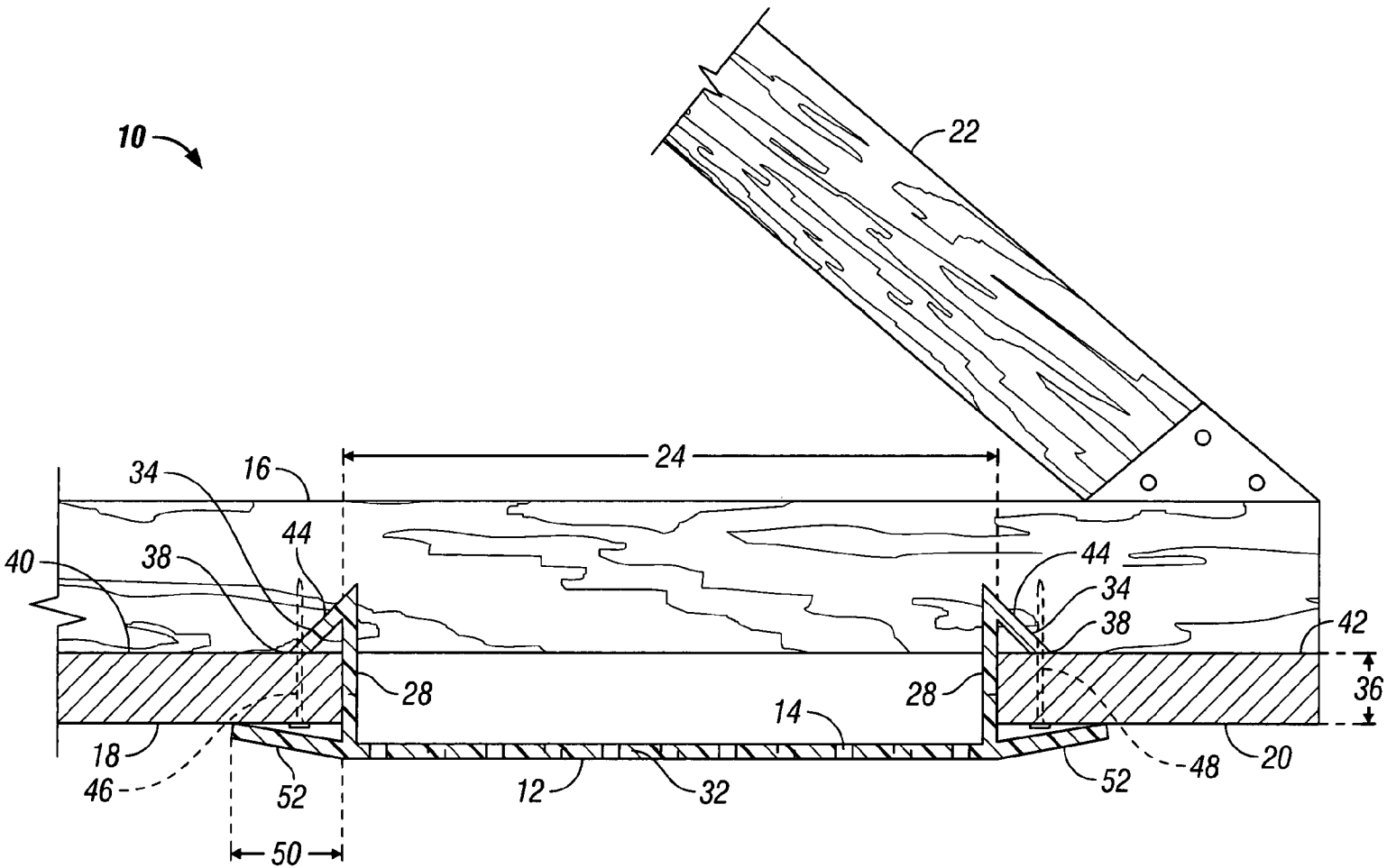
FIG. 1 is an elevational view, partially in section, showing a soffit vent assembly in accord with the present invention.

Referring now to the drawings and, more particularly to FIG. 1 there is shown one possible embodiment of soffit assembly 10 in accord with the present invention.

Soffit assembly 10 comprises a preferably plastic soffit vent 12 which may be extruded or molded or otherwise manufactured. Any suitable material may be utilized which is operable to perform all or selected of the preferred functions of the present invention as discussed herein.

Soffit vent 12 is inserted into soffit assembly 10 to become an integral portion thereof. Soffit vent 12 preferably comprises a plurality of vent holes 14. Holes 14 are more easily visible in FIG. 2 and FIG. 3. Soffit vent 12 may accordingly be utilized to provide excellent ventilation for soffit 10.

Figure 2:
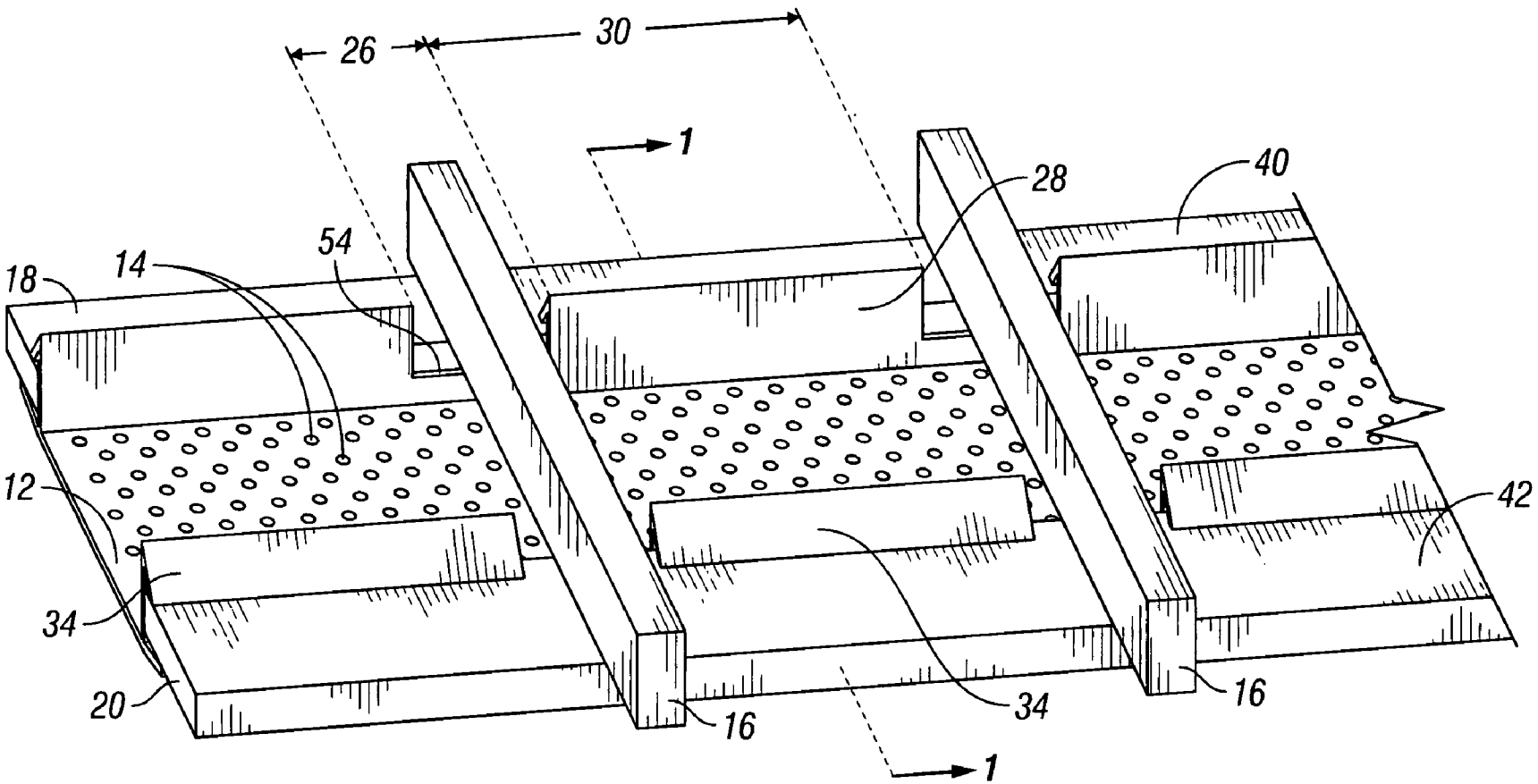
FIG. 2 is a perspective view, showing a soffit assembly including lookouts or joists with a soffit vent mounted in accord with the present invention.

Soffit assembly 10 for a house or building will generally comprise elements such as joist or lookout 16, inner soffit board 18, and outer soffit board 20. It will be understood variations in soffit assembly 10 may occur, e.g., two or more inner soffit boards and/or two or more outer soffit boards. A perspective view of typical soffit assembly 10 components is shown in FIG. 2. Depending on the particular building construction type, rafter 22 (FIG. 1) and/or other roof components may be utilized in soffit assembly 10.

In a presently preferred embodiment, soffit opening or gap 24 is formed between inner soffit board 18 and outer soffit board 20. As discussed hereinbefore, prior art methods and constructions for mounting a soffit vent within soffit opening or gap 24 have many disadvantages that are solved by the soffit vent 12 of the present invention.

For instance, soffit vent 12 in accord with the present invention may be installed into soffit opening or gap 24 quite easily, simply by pushing it in, despite the problems encountered in prior art devices to achieve this. One significant installation problem never solved and never actually recognized with prior art soffit vents has been caused by lookouts, such as lookouts 16. Lookouts 16 may, generally speaking, be spaced from about one to two feet apart and more typically are spaced from sixteen inches to twenty-four inches apart. Lookouts, as use herein, comprise beams that span the soffit opening or gap 24. Lookouts 16 prevent the use of prior art soffit vents of any practical length, e.g. about eight feet because the lookouts block soffit opening or gap 24. Accordingly, standard size soffit vents could not be mounted without construction techniques that require two persons including steps such as separately mounting inner soffit board 18 and outer soffit board 20.

Referring to FIG. 2, there are shown lookouts 16 which may typically be spaced at standardized construction intervals at about sixteen inches or twenty-four inches apart. In accord with one preferred embodiment, soffit leg gaps 26 are preferably formed in soffit legs 28 in one embodiment thereof to thereby permit insertion of soffit vent 12 into soffit opening or gap 24 (See FIG. 1) without being blocked by lookouts 16. Soffit leg gaps 26 receive lookouts 16 to thereby permit insertion of a long strip of soffit vent 12 into soffit gap 24 despite the presence of lookouts 16 which would otherwise block insertion of prior art soffit vents. Soffit leg gaps 26 and the distance 30 (see FIG. 2) between soffit leg gaps 24 are preferably selected to permit use of a long strip of soffit vent 12 for use within typical soffit assemblies. If desired, the spacings can be changed as necessary if special lookout spacings are utilized. In one presently preferred embodiment, soffit gap 26 may be approximately four inches. Distance 30 may typically be approximately sixteen inches or twenty inches. However, this spacing can be widely adjusted as desired. Moreover, soffit leg gaps 26 may be selected to adapt to any of several different standardized spacings so that the same soffit vent 12 structure can be used regardless of which standardized spacing is utilized for the spacing of lookouts 16. Note that even relatively short sections, as described by distance 30, of soffit legs 28, can be utilized to securely mount soffit vent 12 because soffit vent 12 has a relatively light weight. Accordingly, a wide variety of lookout spacings can be accommodated, if desired, even using a standard soffit vent 12 construction.

Figure 3:
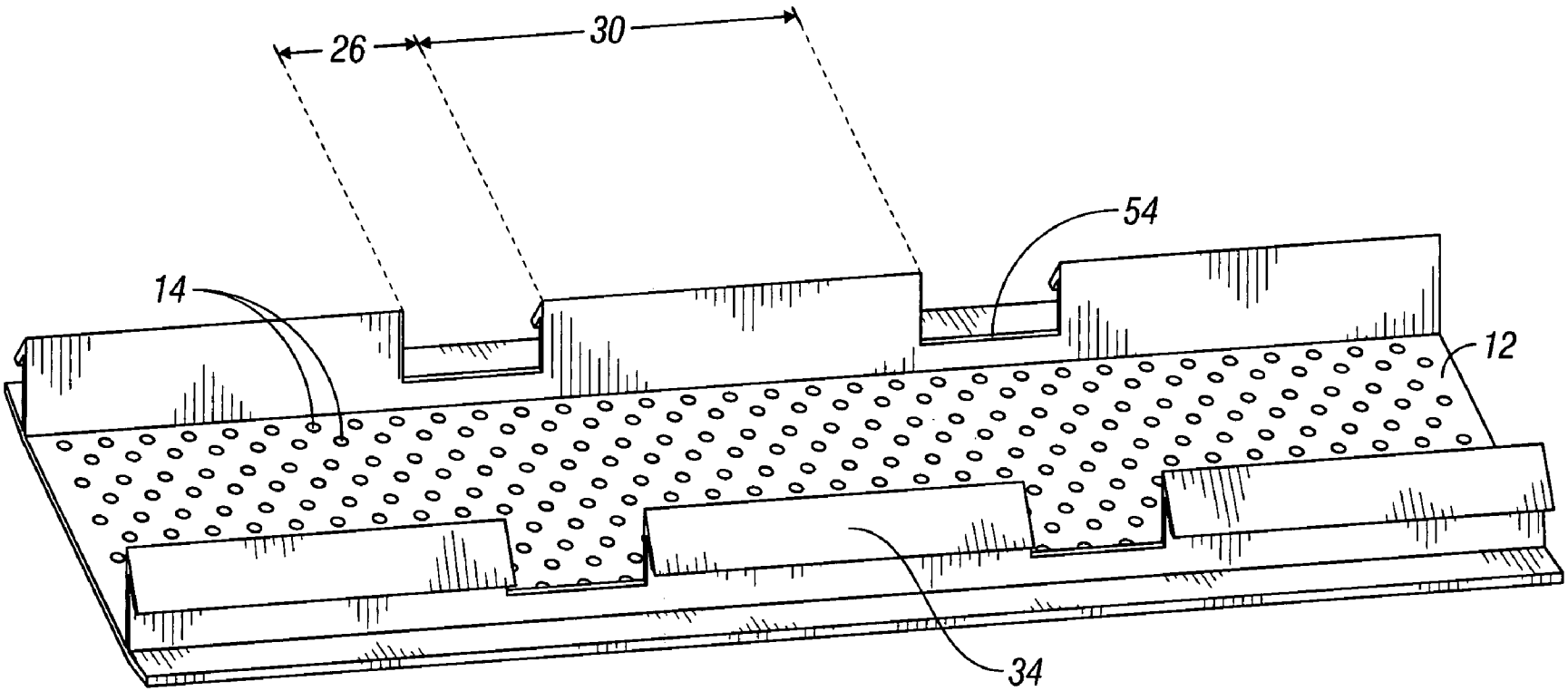
FIG. 3 is a perspective view, showing one possible embodiment of a soffit vent assembly in accord with the present invention.

As shown in FIG. 3, recessed portion 54 is utilized to form soffit leg gap 26. Recessed portion 54 may preferably be cut to a depth which leaves less of soffit leg 28 than any anticipated soffit board width 36 (see FIG. 1). However, if desired, recessed portion 54 may be cut out to any depth. For instance, the cut out of gap 26 may extend to the top of the vent section 32, if desired, or to any desired depth. If gap leg blank portion 54 is utilized rather than cutting out the gap completely or providing separate legs 28, then gap leg blank portion 54 provides some additional support strength for soffit vent legs 28. However, as previously noted the light weight of soffit vent 12 does not actually require additional support strength for soffit vent legs 28 to securely hold it in place.

Referring to FIG. 1, it will appreciated that the combination of lower vent portion 32 and soffit vent legs 28 is preferably sufficiently flexible to thereby permit insertion of soffit vent legs 28 into soffit opening or gap 24. Vented lower section 32 of soffit vent 12 may be rather rigid if desired, or may be flexible if desired. Vented lower section 32 provides an elongate base portion for soffit vent 12 which may typically be sold in strips eight feet or so long. If desired, the bending of legs 28 may be due to a flexibility of legs 28 does not require that lower vent section 32 be flexible for easy insertion of legs 28 into soffit opening or gap 24. However, soffit legs 28 may also be rigid with the flexibility to insert the legs into gap 24 coming for the most part, or perhaps entirely, due to flexibility of vented lower section 32. If a thicker, heavier vented lower section 32 provides a better appearance which is also much less likely to crack or break during installation or transportation, or for other reasons, the thickness of lower section 32 will not interfere with operation of soffit vent 12 in accord with one embodiment of the present invention. However, vented lower section 32 may also be made longitudinally resiliently bendable if desired so that some or all flexibility is produced thereby. In any event, the combination of vented lower section 32 and soffit legs 28 is sufficiently flexible to permit insertion of legs 28 into gap 24 even though tips 38 are wider than gap 24. Legs 28 are pushed into gap 24 until tips 38 pass the top of the soffit boards and, due to resilience, expand outwardly to thereby hold soffit vent 12 in position.

Soffit leg retainers 34 also may or may not be somewhat flexible/resilient to accommodate variations in widths 36 of inner and outer soffit boards 18 and 20 as may occur. Soffit leg retainers may also be quite stiff or rigid as compared to lower vent section 32, if desired. Due to a preferred flexibility of at least one of vented lower section 32 and/or legs 28 and due to at least some flexibility/resilience of finish edges 52 as mounted to vented lower section 32, if the soffit board width 36 is thinner than anticipated, then resilience at retainer 34 tip 38 will still apply tension or a biasing force against the upper surface 40 of inner soffit board 18 and the upper surface 42 of outer soffit board 20. On the other hand, if soffit board width 36 is larger than anticipated, then legs 28 will bend inwardly and/or retainer 34 will bend upwardly so that tip 38 will be able to engage the upper surfaces of the inner and outer soffit boards to apply tension thereto for holding soffit vent 12 in position. Even relatively rigid legs 28 and rigid finish edges 52 are made of plastic material that may bend somewhat for this purpose. However, legs 28 and/or finish edges 52 could be more flexibly resilient or be resiliently mounted to a flexible lower vent portion 32 that permits this function.

In one presently preferred embodiment, soffit leg retainer 34 is angled downwardly to provide an acute angle between leg 28 and soffit leg retainer 34. As well, soffit leg retainer 34 may preferably have a relatively smooth upper surface 44. Accordingly, as soffit vent 12 is inserted into soffit opening or gap 24, then upper surface 44 slidably engages the edges of the inner and outer soffit boards within soffit gap. The engagement of upper surface 44 causes legs 28 or vented lower section 32 and/or retainer 34 and/or lower vent portion 32 to bend to permit the insertion of soffit vent 12 into soffit opening or gap 24. In one preferred embodiment, legs 28 and retainers 34 are relatively rigid and not easily bent. In this embodiment, most or all bending is due to bending of vented lower section 32.

As soffit vent 12 is inserted, once ends 38 of retainers 34 clear upper surfaces 40 and 42 of inner and outer soffit boards 18 and 20, then retainer 34 snaps outwardly into position to hold soffit vent 12 in position. The relative flexibility of vented lower section 32, retainer 34, and leg 28 may be adjusted as desired. In one preferred embodiment, retainer 34 and leg 28 are both substantially equally rigid. In another embodiment, leg 28 may be relatively rigid or flexible as desired. Moreover, finish edge 52 may or may not be flexible. Finish edge presses against the lower surfaces of inner and outer soffit boards 18 and 20 until end 38 engages the upper surfaces thereof. Finish edge 52 may have substantially the same rigidity as leg 28 and retainers 34 in one preferred embodiment. In this case, most flexibility is provided by vented lower section 32. However, any of the various components may be made more flexible or more rigid so long as soffit vent 12 can be inserted into gap 24 as discussed herein.

The present soffit vent 12 is able to adapt to significant variations in width 36 of the inner and outer soffit boards without affecting the uniform and finished look of the present invention thereby potentially reducing the number of different sizes of vents necessary to manufacture. Prior art soffit vents may have a shadow appearance if the soffit boards are too thin. The shadow appearance may require spackling or paint to correct thereby increasing installation time. Alternatively, some prior art designs may not even be usable if the soffit boards are somewhat thicker than planned. Note that while legs 28 are shown to be substantially perpendicular to vent section 32, that legs 28 could be angled somewhat either inward or outwardly if desired.

As well, legs 28 or vented lower section 32 may be sufficiently flexible that soffit vent 12 may be pulled out of opening or gap 24, if desired. In this way, soffit vent 12 effectively provides a removable access door to soffit assembly 12 as might be desirable to install wiring, pipes, and so forth. Unlike the prior art soffits, the present invention thereby provides means to permit removal/installation of the soffit vent without removing soffit boards.

Retainers 34 are shown in a presently preferred embodiment which may be easily manufactured. However, retainers 34 may comprise a wide range of different configurations that may include rounded portions, straight portions, sectional locations, clips, added elements, spring-loaded elements, or the like. Retainers 34 may comprise any shape, configuration, or construction whereby retainers 34 are utilized to retain soffit vent 12 in position. Retainers 34 may be flexible or rigid.

It will also be noted that inner soffit board 18 and outer soffit board 20 may be completely assembled utilizing nails 46 and 48 prior to insertion of soffit vent 12 into position which is not possible in prior art embodiments. As discussed hereinbefore, once the soffit boards are mounted to lookouts 16, then the soffit screen support leg cannot be inserted. Also, in the prior art, the mounting nails, such as nails 46 and 48, have to be put outside of coverage of finish edge 52. This often necessitates spackling and/or painting of the tops of the nails to provide a desired appearance. However, in accord with the present invention, if nails 46 and 48 are provided inside finish edge width 50 as shown in FIG. 1, then nails 46 and 48 are covered by finish edge 52; therefore, no further spackling/painting is required, thereby significant reducing the work time and still providing a desired appearance.

Another advantage of the present invention is that it gives builders the option to complete the soffit assembly, including painting, and then put in the soffit vent. Alternatively, the builder could install the soffit vent and then paint it as is generally required with prior art designs.

As noted above, in a preferred embodiment finish edge 52 is preferably mounted to flexible and resilient lower vent section 32 and is angled upwardly with respect to lower vent section 32 to thereby apply a biasing force against the lower surface of inner and outer soffit boards 18 and 20. This biasing force induces engagement of retainer tips 38 to the tops of soffit board 18 and 20. Thus, soffit screen 12 provides a close fit but adjusts within a relatively wide range of soffit board thicknesses 36 to provide a desired appearance with no additional work required. This has not been the case with prior art soffit screens. Flexibility and/or resiliency may be achieved with various combinations of rigid and flexible/resilient components of soffit vent 12 as deemed most desirable.

Finish edge 52 preferably extends outwardly from vented lower section 32 wherein vented lower section 32 has a width approximately equal to the width of soffit gap 24. However, finish edge 52 may comprise a portion of vented lower section 32. In one possible embodiment, lower section 32 may be V-shaped with the finish edge 52 being an outer edge of the V-shape. Finish edge 52 as mounted on vented lower section 32 preferably provides a biasing force against the lower surfaces of inner soffit board 18 and outer soffit board 20 to thereby move lower section 32 away from the soffit boards until engagement at tips 38 occurs thereby producing a very uniform, pleasing, finished looked. However, other means such as clips, plastic bendable portions, and even spring elements could be utilized to produce this desirable effect, if desired. Moreover, finish edge 52 may take other shapes both in cross-section and lengthwise. For instance, the ends of finish edge 52 might bend upwardly or the entire finish edge 52 may be rounded so as to produce a different cross-sectional appearance. The length wise profile of edge 52 may be straight as shown but could also include undulations, patterns, or the like as might be desired for stylistic purposes.

Another advantage of the present invention is that soffit screen 12 is generally flexible enough so that it can be removed without removing the soffit boards as may be desirable when inspecting the soffit area and/or when installing cables or the like. Prior art soffit screens generally do not permit this. Moreover, in some cases where a prior art soffit screen is of the type where it can be removed or has been removed, then soffit screen 12 can be inserted without the need to replace the soffit boards.

Yet another advantage of the present invention is that variations in the width of soffit opening or gap 24 can be accommodated. Due to the length of retainer 34, and the flexible nature of the overall combination of components forming soffit vent 12, if soffit opening or gap 24 is somewhat wider than anticipated, then soffit screen 12 still fits. As well, if soffit opening or gap 24 is narrower than anticipated, then legs 28 and/or lower vent section 30 bend to permit adjustment. If soffit gap 24 is wider than anticipated, then finish edges 50 cover the additional width to provide a uniform, finished appearance.

In general, it will be understood that such terms as "up," "down," "vertical," and the like, are made with reference to the drawings and/or the earth and/or the typical orientation of the components in a typical soffit. It will be understood that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. The relative size and shape of the components may be greatly different from that shown and the invention still operate in accord with the novel principals taught herein.

Although a particular soffit assembly and method has been described, other possible constructions could be used. The foregoing disclosure and description of the invention is therefore illustrative and explanatory of a presently preferred embodiment of the invention and variations thereof, and it will be appreciated by those skilled in the art that various changes in the design, organization, order of operation, means of operation, equipment structures and location, methodology, and use of mechanical equivalents, as well as in the details of the illustrated construction or combinations of features of the various elements, may be made without departing from the spirit of the invention. Moreover, the scope of a patent is not limited to its literal terms but instead embraces all equivalents to the claims described.

Accordingly, because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative of a presently preferred embodiment and not in a limiting sense.

What is claimed is:

1. A soffit vent for use in a soffit assembly, said soffit assembly comprising an inside soffit board portion and an outside soffit board portion that define a soffit opening, a plurality of lookouts which span said soffit opening, said soffit vent comprising:

an elongate base portion defining one or more vent holes therein;

at least two finish edges extending outwardly from opposite sides of said elongate base portion, at least one of said elongate base portion or said at least two finish edges being flexibly resilient, said at least two finish edges being thereby biased to resiliently engage lower surfaces of said inside soffit board portion and outside soffit board portion after said elongate base portion is inserted into said soffit vent opening such that said at least two finish edges produce a biasing force against said lower surfaces of said inside soffit board portion and said outside soffit board portion to bias said elongate base away from said inside soffit board portion and said outside soffit board portion, whereupon after movement of said elongate base portion away from said inside soffit board portion and said outside soffit board portion then said at least two finish edges are oriented at an angle with respect to said inside soffit board portion and said outside soffit board portion, and then furthermore only respective outermost surfaces of said at least two finish edges physically engage respective of said inside soffit board portion and said outside soffit board portion and except for said respective outermost surfaces said at least two finish edges do not contact said inside soffit board portion and said outside soffit board portion; and one or more legs mounted to said elongate base portion and extending away from said base portion, said one or more legs being adapted for insertion into said soffit opening, said one or more legs defining a plurality of recesses, said plurality of recesses being spaced in coordination with said plurality of lookouts to thereby permit insertion of said one or more legs on said elongate base portion into said soffit opening without being blocked by said lookouts.

2. The soffit vent of claim 1, wherein said elongate base portion has a width approximately equal to an elongate width of said soffit opening.

3. The soffit vent of claim 1, wherein an outermost edge of said at least two finish edges defines a width greater than said width of said soffit opening.

4. The soffit vent of claim 1, wherein said elongate base portion and said at least two edges are formed as a single monolithic piece during manufacture thereof.

5. The soffit vent of claim 1, further comprising:

retainers mounted to said elongate base portion, said retainers being shaped to engage said inside soffit board portion and said outside soffit board portion after insertion of said soffit vent into said soffit opening.

6. A soffit vent for use in a soffit assembly, said soffit assembly comprising an inside soffit board portion and an outside soffit board portion that define a soffit opening, a plurality of lookouts which extend across said soffit opening, a lookout spacing distance between at least two of said lookouts, said soffit vent comprising:

an elongate base portion defining one or more vent holes therein, said elongate base portion being longer than said lookout spacing distance;

one or more legs mounted to said elongate base portion and extending away from said base portion, said one or more legs being adapted for insertion into said soffit opening, said one or more legs defining a plurality of recesses, said plurality of recesses being spaced in coordination with said plurality of lookouts to thereby permit insertion of said one or more legs into said soffit opening without being blocked by said lookouts.

7. The soffit vent of claim 6, wherein said one or more legs are mounted on opposite sides of said elongate base portion, said one or more legs and said elongate base portion being formed as a monolithic structure during manufacture thereof.

8. The soffit vent of claim 6, wherein said one or more legs are moveable during said insertion into said soffit opening.

9. The soffit vent of claim 6, further comprising one or more retainers mounted to said one or more legs, said one or more retainers defining a profile configured to retain said soffit vent in position after insertion of said base portion into said soffit opening.

10. The soffit vent of claim 6, further comprising at least one finish edge extending outwardly from each side of said base portion, said finish edge forming an angle with respect to said base portion.

11. The soffit vent of claim 6, further comprising at least one finish edge extending outwardly from each side of said base portion, said at least one finish edge being profiled to engage a lower surface of said inside soffit board portion and said outside soffit board portion after insertion of said elongate base portion into said soffit opening to thereby bias said elongate base portion to move away from a lower surface of said inside soffit board portion and said outside soffit board portion.

12. A soffit vent for use in a soffit assembly, said soffit assembly comprising an inside soffit board portion and an outside soffit board portion that define a soffit opening therebetween, a plurality of lookouts which span said soffit opening such that said inside soffit board portion and said outside soffit board portion are affixed into a finished position with respect to said plurality of lookouts, said soffit vent comprising:

an elongate base portion defining one or more vent holes therein;

one or more retainers mounted with respect to said elongate base portion and extending away from said elongate base portion, said one or more retainers comprising retainer outer surfaces arranged such that as said one or more retainers are inserted into said soffit opening, then said retainer outer surfaces engage said inside soffit board portion and said outside soffit board portion to thereby compress said one or more retainers inwardly, once said retainer outer surfaces are inserted past said inside soffit board portion and said outside soffit board portion, then said one or more retainers move outwardly to thereby grip interior surfaces of said inside soffit board portion and said outside soffit board portion whereupon said soffit vent is configured for insertion into said soffit opening after said inside soffit board portion and an outside soffit board portion are affixed into said finished position with respect to said plurality of lookouts; and one or more legs mounted to said elongate base portion and extending away from said base portion, said one or more legs being adapted for insertion into said soffit opening, said one or more legs defining a plurality of recesses, said plurality of recesses being spaced in coordination with said plurality of lookouts to thereby permit insertion of said one or more legs into said soffit opening without being blocked by said lookouts.

13. The soffit vent of claim 12, further comprising:

at least two finish edges extending outwardly from opposite sides of said elongate base portion, said at least two finish edges resiliently engaging lower surfaces of said inside soffit board portion and outside soffit board portion after said elongate base portion is inserted into said soffit vent opening such that said at least two flexible finish edges are operable to produce a biasing force against said lower surfaces of said inside soffit board portion and said outside soffit board portion to bias said elongate base away from said inside soffit board portion and said outside soffit board portion.

14. The soffit vent of claim 12, wherein said one or more retainers are mounted on said one or more legs.

15. The soffit vent of claim 12, wherein said one or more retainers and said elongate base portion are formed as a monolithic structure during manufacture thereof.

* * * * *